US012435473B2

(12) United States Patent
Rieger

(10) Patent No.: US 12,435,473 B2
(45) Date of Patent: Oct. 7, 2025

(54) CONNECTION SYSTEM FOR MONORAIL BEAMS

(71) Applicant: SANDVIK MINING AND CONSTRUCTION G.M.B.H., Zeltweg (AT)

(72) Inventor: Hubert Rieger, Mobersdorf-Siedlung (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 757 days.

(21) Appl. No.: 17/778,314

(22) PCT Filed: Nov. 20, 2019

(86) PCT No.: PCT/EP2019/081860
§ 371 (c)(1),
(2) Date: May 19, 2022

(87) PCT Pub. No.: WO2021/098954
PCT Pub. Date: May 27, 2021

(65) Prior Publication Data

US 2023/0002978 A1 Jan. 5, 2023

(51) Int. Cl.
*E01B 25/24* (2006.01)

(52) U.S. Cl.
CPC ..... *E01B 25/24* (2013.01)

(58) Field of Classification Search
CPC ..... E01B 25/24; E01B 25/22
See application file for complete search history.

(56) References Cited

U.S. PATENT DOCUMENTS

| | | | | |
|---|---|---|---|---|
| 7,078,623 | B1 * | 7/2006 | Sheehan | H02G 3/0616 174/152 G |
| 2022/0325626 | A1 * | 10/2022 | Rieger | E21D 21/0093 |
| 2023/0002978 | A1 * | 1/2023 | Rieger | E01B 25/24 |

FOREIGN PATENT DOCUMENTS

| | | | | |
|---|---|---|---|---|
| CN | 115638176 | A * | 1/2023 | |
| DE | 2107922 | | 8/1972 | |
| DE | 2922086 | | 12/1980 | |
| DE | 3243753 | A1 | 5/1984 | |
| DE | 3910542 | C1 * | 8/1990 | |
| FR | 2152213 | A5 | 4/1973 | |
| GB | 1559101 | | 1/1980 | |
| GB | 1559101 | A * | 1/1980 | E01B 25/24 |
| GB | 2081658 | A * | 2/1982 | E01B 25/24 |
| RU | 2611660 | C1 | 2/2017 | |
| WO | WO-2011072327 | A1 * | 6/2011 | B23P 19/068 |
| WO | WO-2021110557 | A1 * | 6/2021 | H01R 13/62955 |
| WO | WO-2024110645 | A1 * | 5/2024 | F24F 1/26 |

* cited by examiner

*Primary Examiner* — Jason C Smith
(74) *Attorney, Agent, or Firm* — Corinne R. Gorski

(57) ABSTRACT

A connection system arranged for connecting a first monorail beam to a second monorail beam includes upper connection means and lower connection means. The lower connection means is configured to support the second beam from below and the upper connection means is configured to be connected by movement of the second monorail beam downwards relative to the first monorail beam, wherein the upper connector limits longitudinal relative movement between the first monorail beam and the second monorail beam when connected.

9 Claims, 2 Drawing Sheets

CONNECTION SYSTEM FOR MONORAIL BEAMS

RELATED APPLICATION DATA

This application is a § 371 National Stage Application of PCT International Application No. PCT/EP2019/081860 filed Nov. 20, 2019.

TECHNICAL FIELD

The present disclosure relates to roof-hung monorails for use in mines. Such monorails are often used to carry movable load-carrying devices for transport purposes.

BACKGROUND

Material and equipment are sometimes transported through a mine using movable load-carrying devices, such as carts, carried on wheels suspended on and guided by a roof-hung monorail. This enables efficient material handling since the material handling may be handled separate from other traffic on the floor of the mine. Also, the roof-hung monorail is useful for suspending ventilation ducts and/or cables.

Typically, a monorail comprises a plurality of beams which are suspended in-line to form the monorail. Several solutions for how to suspend the beams exist. Also, several solutions exist for how to interconnect the ends of the beams to form a smooth and robust connection.

One example of a monorail is shown in DE2107922. The monorail comprises beams one end of which are provided with a suspension hook to suspend the end of the beam in a chain. The next beam in-line is provided with a horizontally protruding hook to be positioned on top of the previous beam in line, under its suspension hook. Separation of the beams is prevented using a transverse pin. This monorail is cumbersome to install and requires use of a chain for suspension.

Another monorail is known from GB1559101. The monorail sections are provided with upper and lower connection means, and the upper connection means of two adjacent beams need to be suspended after connection of the adjacent beams by insertion of a transversal bolt or tie rod which interlocks the upper connection means and enables suspension. This monorail is cumbersome to install.

Yet another monorail beam is known from DE2922086. This monorail comprises connection means similar to the ones of GB155910 but the upper connectors are not locked together. This monorail is also cumbersome to install.

Accordingly, an object of the invention is to simplify installation of a monorail. A further object is to promote automated installation of the monorail.

SUMMARY

According to a first aspect of this disclosure, these and other objects are achieved by a connection system for a monorail as defined in claim 1 with alternative embodiments defined in its dependent claims.

The connection system is for connecting a first monorail beam to a second monorail beam. The connection system comprises upper connection means and lower connection means. The lower connection means comprises a support member attachable to a first end portion of the first monorail beam. The support member comprises a support surface extending out from the first end portion of the first monorail beam along a longitudinal axis of the first monorail beam for supporting a second end portion of the second monorail beam from below. The upper connection means comprises a female interlocking means attachable to the first end portion of the first monorail beam and a corresponding male interlocking means attachable to the second end portion of the second monorail beam. The male interlocking means is configured to extend outside the second end portion of the second monorail beam along a longitudinal axis of the second monorail beam. The male interlocking means comprises a locking protrusion and the female interlocking means comprises a slot for containing at least a portion the locking protrusion when the first and second beams are connected such that relative movement between the male and female interlocking means along the length of the first and second monorail beams is limited by confinement of the locking protrusion within the slot. The slot is upwardly open by means of a first opening for receiving the locking protrusion from above at connection of the first monorail beam and the second monorail beam Such a connection system can be added to ends of monorail beams to enable swift and easy connection and alignment of the monorail beams. When the upper and lower connection means have been applied to the first and second monorail beams they can be mounted to form a monorail section as follows: First, the first monorail beam is first attached to a roof to begin building the monorail. The attachment to the roof is made by any suitable means such as using a threaded rod with or without a quick-release connector. Thereafter, the upper and lower connectors are brought in close proximity to one another with the beams substantially aligned with each other, wherein the male and female interlocking means of the upper connector are connected by inserting the locking protrusion from above into the slot of the female interlocking means until the second beam rests on the support member attached to the first monorail beam. In this position, the first and second monorail beams are aligned and connected with one end of the second monorail beam resting on the first monorail beam whilst allowing some degree of freedom of movement of the rest of the second monorail beam, thereby allowing for easier attachment of the second monorail beam to the roof. The process is then repeated for subsequent monorail beams to form the monorail.

The slot may be shaped and sized to provide a space allowing the locking protrusion to move a predetermined distance back and forth along the length of the first monorail beam.

Such configuration of the slot allows a greater adjustability of the monorail extension by allowing the first monorail beam and the second monorail beam to remain connected despite jointly forming a vertically curved monorail. Also, the greater adjustability enables easier adjustment at installation.

The slot may be arcuate about a rotational axis transversal to the longitudinal axis of the first monorail beam, said rotational axis extending adjacent or through the lower connection means.

The locking protrusion may extend transversally to the longitudinal direction of the second monorail beam.

The locking protrusion may comprise a bar extending transversally to the longitudinal direction of the monorail beam.

The male interlocking means may comprise two parallel shanks and wherein the bar extends between the shanks.

The female interlocking means may comprise a latch movably attached to the female interlocking means for movement between a locking position in which the latch prevents the locking protrusion from moving upwards out of the slot and an unlocking position in which the latch does not prevent the locking protrusion from moving upwards out of the slot.

The latch secures the locking protrusion within the slot and prevents unintentional disconnection of the upper connector.

The female interlocking means may comprise a biasing means configured to bias the latch towards its locking position.

The biasing means forces the latch towards its locking position and thereby assists in moving the latch back to its closed position upon installation and further prevents unintentional opening of the latch.

An end portion of the latch is chamfered or otherwise shaped to define a slanted surface 19 angled to allow the latch to be forced from its locking position towards its unlocking position by pushing the locking protrusion downwards towards the slot from above.

The support member comprises a first interlocking means configured to vertically mate with a corresponding second interlocking means provided on a lower portion of the second monorail beam, wherein the first interlocking means and the second interlocking means engage such that they are not movable relative to each other in a horizontal plane when interlocked.

According to a second aspect of the disclosure, these and other objects are also achieved by a monorail system as defined in claim.

The monorail system comprises the connection system according to the first aspect described above. The monorail system also comprises the first monorail beam and the second monorail beam described above in relation to the first aspect. The first and second monorail beams are provided with the connection system such that they are connectable by the upper and lower connection means.

BRIEF DESCRIPTION OF DRAWINGS

FIG. 1 shows a side view of two adjacent monorail beams, with their central portions cut-away for illustrative purposes. The figure also shown the connection system used to connect the two beams in a position before connection.

FIG. 2 shows the connection system also shown in FIG. 1 in a first step of connection in which the locking protrusion of the male interlocking means of the upper connection means is on its way down through the opening of the upwardly open slot of the corresponding female interlocking means of the upper connection means. The female interlocking means and is shown in cross-section in a vertical plane in order to better show the latch and the biasing means.

FIG. 3 shows the connection system also shown in FIGS. 1 and 2 after connection. The female interlocking means and is shown in cross-section in a vertical plane in order to better show the latch and the biasing means.

DETAILED DESCRIPTION

Figure 1:
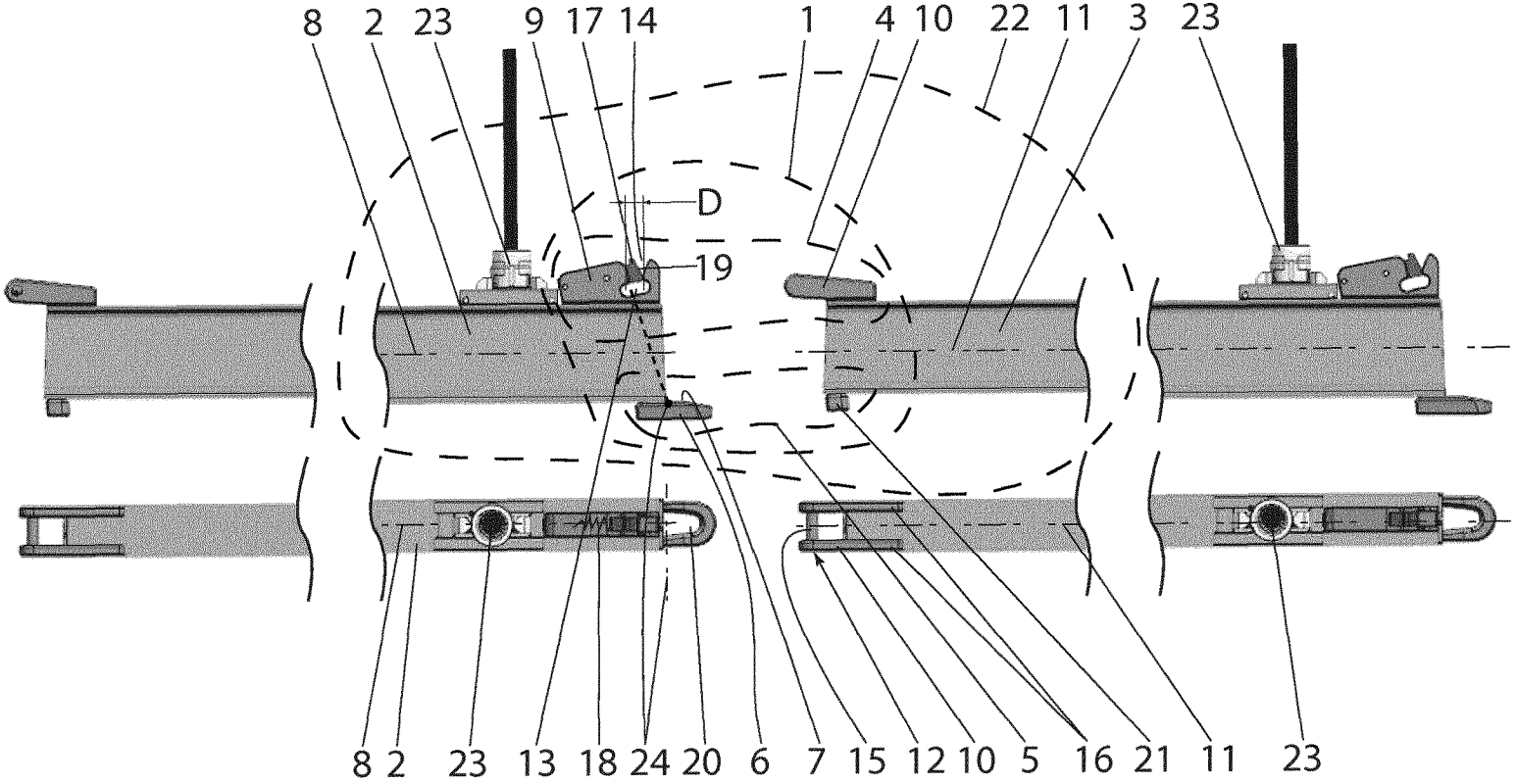
FIGS. 1-3 all relate to a connection system for a monorail according to a first embodiment.
Figure 2:
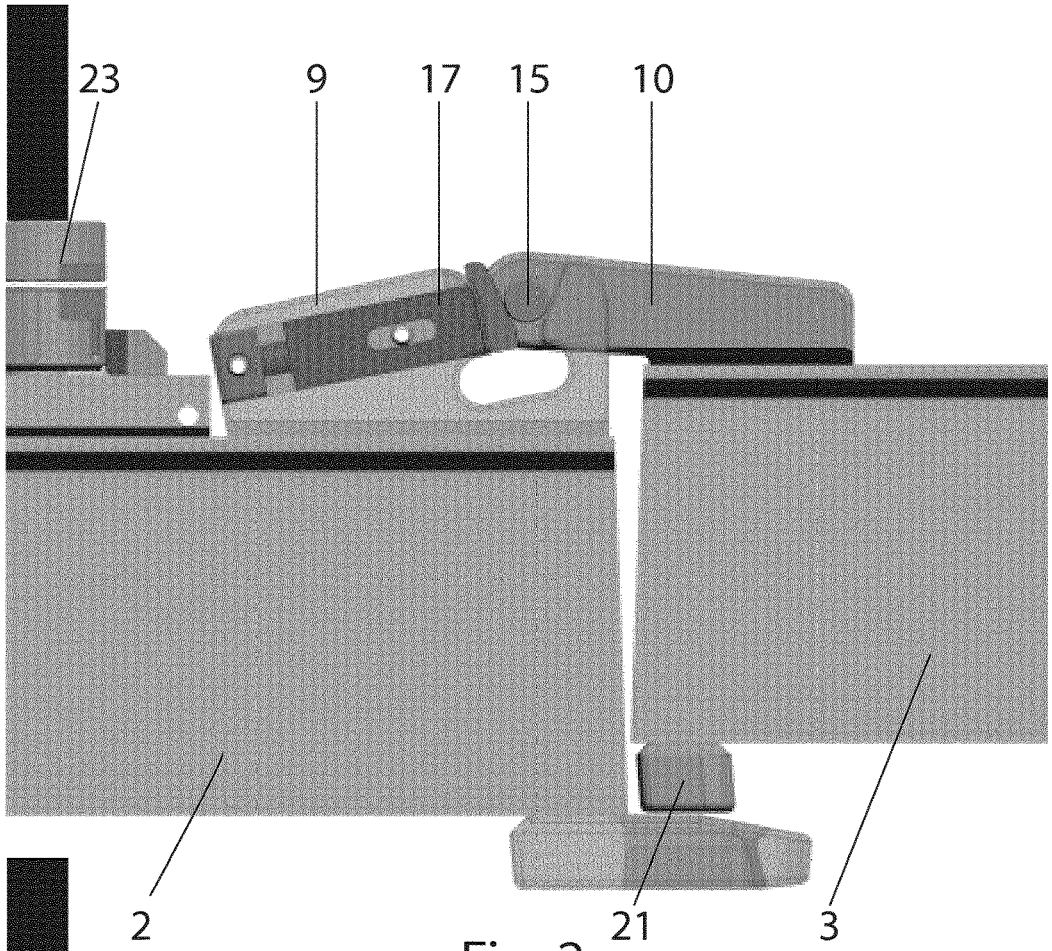
Figure 3:
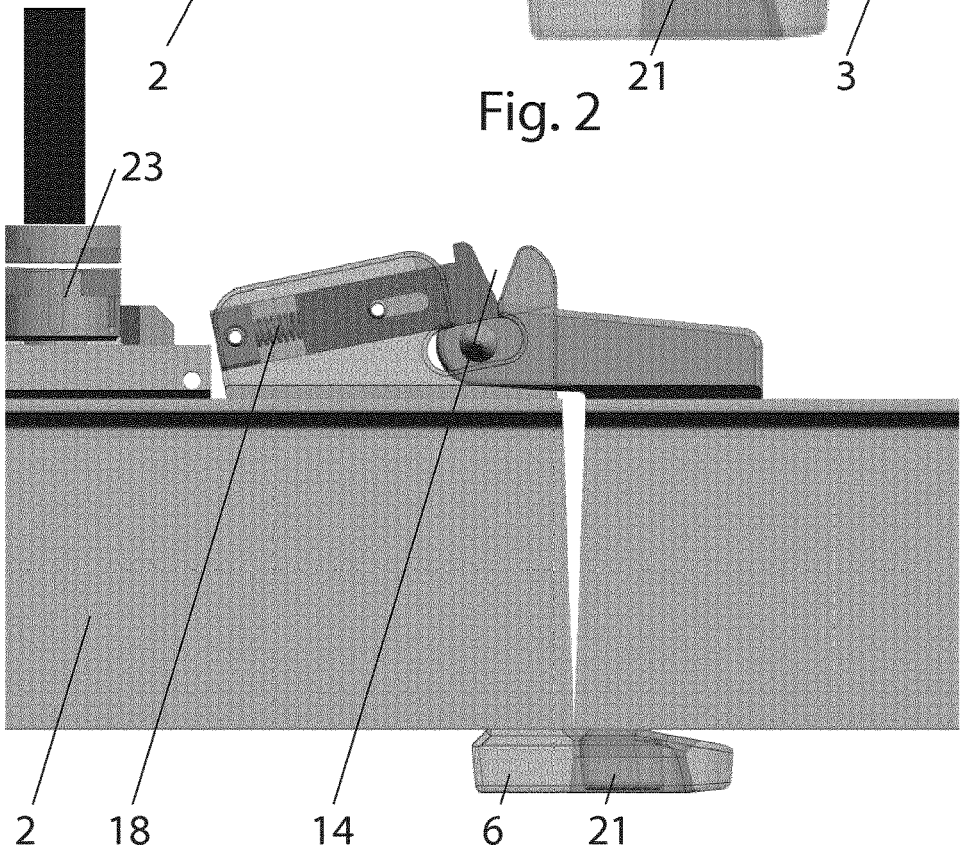

A connection system 1 according to a first embodiment will hereinafter be described with reference to FIGS. 1-3.

The connection system 1 is for connecting a first monorail beam 2 to a second monorail beam 3. The monorail beams 2, 3 are shown with their respective central portions cut-away for illustrative purposes. The connection system 1 comprises upper connection means 4 and lower connection means 5. The lower connection means 5 comprises a support member 6 attachable to a first end portion of the first monorail beam 2. The support member 6 comprises a support surface 7 extending out from the first end portion of the first monorail beam 2 along a longitudinal axis 8 of the first monorail beam 2 for supporting a second end portion of the second monorail beam 3 from below. The upper connection means 4 comprises a female interlocking means 9 attachable to the first end portion of the first monorail beam 2 and a corresponding male interlocking means 10 attachable to the second end portion of the second monorail beam 3. The male interlocking means 10 is configured to extend outside the second end portion of the second monorail beam 3 along a longitudinal axis 11 of the second monorail beam 3. The male interlocking means 10 comprises a locking protrusion 12 and the female interlocking means 9 comprises a slot 13 for containing at least a central portion the locking protrusion 12 when the first and second beams 2, 3 are connected such that relative movement between the male and female interlocking means 10, 9 along the length of the first 2 and second 3 monorail beams is limited by confinement of the locking protrusion 12 within the slot 13. The slot 13 is upwardly open by means of a first opening 14 for receiving the locking protrusion 12 from above at connection of the first 2 and second 3 monorail beams.

The slot 13 is shaped and sized to provide a space allowing the locking protrusion 12 to move a predetermined distance D back and forth along the length of the first monorail beam 2.

The slot 13 is arcuate about a rotational axis 24 transversal to the longitudinal axis 8 of the first monorail beam 2. The rotational axis 24 extends through the lower connection means 5 but could in other embodiments alternatively extend otherwise thereby giving the arcuate shape of the slot 13 another curvature such as straight. An advantage of making the arcuate shape arcuate about a rotational axis 24 through the lower connection means 5 is that the angle between the connected first 2 and second 3 monorail beams may be varied by relative rotation about the lower connection means 5, thereby enabling more adjustability during and after install of the monorail beams 2, 3.

The male interlocking means 10 comprises two parallel shanks 16 and a locking protrusion 12 in the form of a bar 15 that extends between the shanks 16 transversally to the longitudinal direction 11 of the second monorail beam. In other embodiments, the locking protrusion 12 may have any other suitable shape and means of attachment to the male interlocking means 10/second monorail beam 3. For example, the bar 15 may alternatively be attached at only one of its ends using only one shank or plate. However, attaching the bar 15 at both opposing ends provides for a robust and secure connection.

The female interlocking means 9 comprises a latch 17 movably attached to the female interlocking means 9 for movement between a locking position (FIG. 3) in which the latch prevents the locking protrusion 12 from moving upwards out of the slot 13 and an unlocking position (not shown in figures) in which the latch 17 does not prevent the locking protrusion 12 from moving upwards out of the slot 13. The latch 17 thus ensures that the upper connection means 4 cannot be unintentionally disconnected. In this embodiment, an end portion of the latch 17 is chamfered to allow the latch 17 to be forced from its locking position towards its unlocking position by pushing the locking protrusion 12 downwards towards the slot 13 from above. This enables easier connection by allowing the connection to be performed by simply forcing the bar 15 through the first opening 14 and into the slot 13. The chamfer could alternatively be replaced with any other suitable shape such as filleted or otherwise rounded.

The female interlocking means 9 comprises a biasing means 18 configured to bias the latch 17 towards its locking position. In this embodiment, the biasing means 18 is a coil spring, but in other embodiments any other suitable biasing 18 means could alternatively be used instead, such as a piece of elastic material, for example a suitable elastomer.

In this embodiment, the support member 6 comprises a first interlocking means 20 configured to vertically mate with a corresponding second interlocking means 21 provided on a lower portion of the second monorail beam 3, wherein the first interlocking means 20 and the second interlocking means 21 engage such that they are not movable relative to each other in a horizontal plane when interlocked. Specifically, the first interlocking means 20 has a U-shaped profile as shown in FIG. 1. The two shanks of the U-shaped profile are welded to a bottom portion of the first monorail beam 2 and extends longitudinally in front of the first monorail beam 2 thereby defining a hole for receiving the second interlocking means 21 which has the form of a protrusion fitting with the hole of the first interlocking means 20. In other embodiments, the hole and the protrusion may alternatively have any other suitable shape as long as they allow for vertical mating and thereafter interlock to prevent horizontal movement at least along the length of the first 2 and second 3 monorail beams. For example, the hole must not be thorough but could simply be a recess.

The material of choice for the first 2 and second 3 monorail beams and for the upper and lower connection means is steel. However, the connection means 4, 5 and the beams 2, 3 could in other embodiments alternatively have any other suitable material, such as aluminium. Factors affecting the choice of material are the required load carrying capacity and the climate in the mine. The monorails 2, 3 are attached to the mine roof (the mine roof is not shown in the figures) using bars or bolts fixed to the mine roof. Each bar is attached to the monorail beam 2, 3 using a suitable connection means such as the snap lock connector 23. The first monorail beam 2 installed may be suspended using more than one bar or bolt. Subsequently attached monorail beams 2 are then installed by first installing a bolt or rod in the mine roof at a suitable location, where after the connection system 1 for connecting the beams 2, 3 is connected by bringing the new monorail beam 2 close to the final position and then hooking together the upper and lower connection means 4, 5 by vertical relative movement until one end of the new monorail beam 3 rests on the prior monorail beam 2 with the upper connection means 4 connected. Thereafter, the new monorail beam 3 is attached to the bolt just installed using the snap-lock connector of the new beam 3. The same process is then repeated for adding additional consecutive beams as needed. The connection system 1 is thus well suited for automated installation since a minimum of operational steps are needed to secure each added monorail beam to a previous monorail beam.

In other embodiments, the snap-lock connector could alternatively be replaced with any other suitable type of connector known in the art. According to this disclosure, the connection of the ends of the beams is separated from the connection to the mine roof. As shown in FIG. 3, the end portion of the beams 2, 3 are slanted or inclined away from each other such that a space between the beams is provided allowing them to be tilted relatively each other within the constraints given by the slot of the upper connection means. Also, it should be understood that as long as the beams 2, 3 to be connected share a common connection system 1, the same connection system design need not be used for connecting all monorail beams but could vary; For example one end of a beam could be provided with a connection system designed larger and more robust than the other end of the beam in order to be able to carry a longer/heavier beam to be connected. However, the typical monorail beam system comprises many beams which share the same type and size of connection system.

The invention claimed is:

1. A connection system for connecting a first monorail beam to a second monorail beam, the connection system comprising:

upper connection means; and lower connection means, wherein the lower connection means includes a support member attachable to a first end portion of the first monorail beam, wherein the support member includes a support surface extending outwardly from the first end portion of the first monorail beam along a longitudinal axis of the first monorail beam for supporting a second end portion of the second monorail beam from below, wherein the upper connection means includes a female interlocking means attachable to the first end portion of the first monorail beam and a corresponding male interlocking means attachable to the second end portion of the second monorail beam, and wherein the male interlocking means is configured to extend outside the second end portion of the second monorail beam along a longitudinal axis of the second monorail beam, characterized in that the male interlocking means including a locking protrusion, wherein the female interlocking means includes a slot arranged for containing at least a portion the locking protrusion when the first and second beams are connected such that relative movement between the male and female interlocking means along the length of the first and second monorail beams is limited by confinement of the locking protrusion within the slot, and wherein the slot is upwardly open by means of a first opening for receiving the locking protrusion from above at connection of the first and second monorail beams, the female interlocking means including a latch movably attached to the female interlocking means for movement between a locking position in which the latch prevents the locking protrusion from moving upwards out of the slot and an unlocking position in which the latch does not prevent the locking protrusion from moving upwards out of the slot, and wherein the female interlocking means includes a biasing means configured to bias the latch towards its locking position.

2. The connection system according to claim 1, wherein the slot is shaped and sized to provide a space allowing the locking protrusion to move back and forth along the length of the first monorail beam.

3. The connection system according to claim 2, wherein the slot is arcuate about a rotational axis transversal to the longitudinal axis of the first monorail beam, said rotational axis extending through the lower connection means.

4. The connection system according to claim 1, wherein the locking protrusion extends transversally to the longitudinal direction of the second monorail beam.

5. The connection system according to claim 1, wherein the locking protrusion includes a bar extending transversally to the longitudinal axis of the first monorail beam.

6. The connection system according to claim 5, wherein the male interlocking means includes two parallel shanks and wherein the bar extends between the shanks.

7. The connection system according to claim 1, wherein an end portion of the latch is chamfered or otherwise shaped to define a slanted surface angled to allow the latch to be forced from its locking position towards its unlocking position by pushing the locking protrusion downwards towards the slot from above.

8. The connection system according to claim 1, wherein the support member includes a first interlocking means configured to vertically mate with a corresponding second interlocking means provided on a lower portion of the second monorail beam, wherein the first interlocking means and the second interlocking means engage such that they are not movable relative to each other in a horizontal plane when interlocked.

9. A monorail system comprising:

a connection system according to claim 1; and a first monorail beam and a second monorail beam, wherein the first and second monorail beams are provided with a connection system such that they are connectable by the upper and lower connection means.

* * * * *